US006311955B1

(12) United States Patent
McGarry et al.

(10) Patent No.: US 6,311,955 B1
(45) Date of Patent: Nov. 6, 2001

(54) FENCING SYSTEM WITH PARTIAL WRAP COMPONENTS AND TONGUE AND GROOVE BOARD SUBSTITUTE

(75) Inventors: Benjamin L. McGarry, Akron; Jack T. Mowery, Medina; Michael A. Fiume, Tallmadge, all of OH (US)

(73) Assignee: Associated Materials, Incorporated, Akron, OH (US)

( * ) Notice: Subject to any disclaimer, the term of this patent is extended or adjusted under 35 U.S.C. 154(b) by 0 days.

(21) Appl. No.: 09/298,823

(22) Filed: Apr. 26, 1999

(51) Int. Cl.[7] ..... E04B 2/08; E04B 2/18; E04H 17/16

(52) U.S. Cl. ..... 256/24; 52/592.1; 52/589.1; 52/795.1; 52/588.1; 256/62

(58) Field of Search ..... 256/24, 13.1, 73, 256/59; 52/589.1, 592.1, 588.1, 795.1

(56) References Cited

U.S. PATENT DOCUMENTS

| | | | | |
|---|---|---|---|---|
| 123,487 | * | 2/1872 | Landis | 256/24 |
| D. 200,702 | * | 3/1965 | Huret | D13/7 |
| 581,653 | * | 4/1897 | Buckingham et al. | 256/48 |
| 1,643,555 | * | 9/1927 | Gledhill | 256/13.1 |
| 2,682,236 | | 6/1954 | Holmstrom et al. . | |
| 2,811,118 | | 10/1957 | Ball . | |
| 3,472,489 | * | 10/1969 | Baylin | 256/22 |
| 4,096,011 | | 6/1978 | Sanders et al. . | |
| 4,104,840 | * | 8/1978 | Heintz et al. | 52/309.9 |
| 4,104,841 | | 8/1978 | Naz . | |
| 4,122,643 | | 10/1978 | Hafner . | |
| 4,149,700 | * | 4/1979 | Stafford | 256/24 |
| 4,272,060 | * | 6/1981 | Stafford | 256/24 |
| 4,308,702 | | 1/1982 | Rajewski . | |
| 4,680,911 | | 7/1987 | Davis et al. . | |
| 4,907,387 | * | 3/1990 | Turnbull | 52/181 |
| 4,964,618 | | 10/1990 | Kennedy et al. . | |
| 5,247,773 | * | 9/1993 | Weir | 52/592 |

(List continued on next page.)

FOREIGN PATENT DOCUMENTS

| | | | | |
|---|---|---|---|---|
| 624333 | * | 11/1962 | (BE) | 52/592.1 |
| 2339047 | * | 2/1975 | (DE) | 52/519 |
| 2076498 | * | 9/1981 | (GB) | 52/519 |

*Primary Examiner*—Lynne H. Browne
*Assistant Examiner*—Ernesto Garcia
(74) *Attorney, Agent, or Firm*—Banner & Witcoff, Ltd.

(57) ABSTRACT

A hybrid fence system includes partial post and rail wrap components and a plurality of uprights, all formed of durable resilient plastic material. The wrap components partially cover existing wood rails and posts. The plastic uprights takes the place of conventional wood uprights, e.g., tongue and groove boards. Three of the four sides of the wood posts are completely covered by the partial post wraps. One face of the posts will remain exposed along a gap of the wrap component, thus allowing the rails to be secured directly to the wood post. The rail wraps are wrapped around the rails in a fashion similar to the post wraps, such that a gap is formed between free longitudinal edges of the wrap, leaving a corresponding area of exposed wood on each rail which allows for attachment of the uprights directly to the rails. The uprights have a generally tubular configuration including opposed longitudinal edges forming a tongue and a groove, respectively. The tongue includes a fastening tab. Aligned slots are provided in the tab for fasteners, e.g., nails, to pass through. The tab configuration is such that the fasteners are directed at an angle aligned with a side surface of the upright adjacent the tab. The arrangement allows the tongue structure and fasteners to be substantially concealed within the mating groove formed in a like adjacent upright. In a completed fence assembly, the strips of wood along the posts and rails, corresponding to the gaps in the post and rail wraps, are substantially concealed by the uprights.

28 Claims, 4 Drawing Sheets

U.S. PATENT DOCUMENTS 5,326,187 * 7/1994 St. Marie et al. ..... 403/402
5,458,942 * 10/1995 Miller ..... 52/738.1
5,480,126 * 1/1996 Teasdale ..... 256/19
5,529,289 * 6/1996 Lancer, Sr. ..... 256/24 X
5,651,227 7/1997 Anderson .
5,657,967 * 8/1997 Patrick ..... 256/24 X
5,702,090 * 12/1997 Edgman ..... 256/24 X
5,725,201 3/1998 Parth .
5,794,390 * 8/1998 Oliveri et al. ..... 256/13.1
6,122,877 * 9/2000 Hendrickson et al. ..... 52/520
6,152,428 * 11/2000 Simioni ..... 256/24

* cited by examiner

FENCING SYSTEM WITH PARTIAL WRAP COMPONENTS AND TONGUE AND GROOVE BOARD SUBSTITUTE

BACKGROUND OF THE INVENTION

The present invention relates to fencing and particularly to fencing employing components formed of durable plastic (e.g., polyvinyl chloride) material.

The prior art includes fencing systems that utilize sleeve or covering structures for cladding associated wood fence posts and rails. See, e.g., Teasdale U.S. Pat. No. 5,480,126 and Miller U.S. Pat. No. 5,458,942. Various configurations of the cladding components are shown in those patents. It is seen that in each, the entire outer circumference of the posts and rails is covered by the wrap.

It is also known to form tongue and groove fence uprights of hollow tubular plastic, and to provide interlocking fence panels serving to conceal points of attachment. Lancer, Sr. U.S. Pat. No. 5,529,289 discloses fence panels which are interlocked in an overlapping shingle-like fashion along a fence line. The end structure of one panel overlays, and thus conceals, the fastener securing an adjacent panel to the horizontal rails. Edgeman U.S. Pat. No. 5,702,090 discloses a plastic fencing system utilizing post and rail structures formed of hollow extruded plastic tubes, as well as hollow tubular plastic uprights ("pickets"). FIG. 6 of that patent shows a hollow picket with a tongue and groove configuration which allows the pickets to be interlocked with each other, as seen in FIG. 2. The pickets or uprights are secured within slots extending along inner faces of upper and lower rails. Center rails and brackets may also be installed.

Parth U.S. Pat. No. 5,725,201 discloses, similar to the Lancer, Sr. patent, fence panels that interlock with each other within a framework constructed of tubular posts and upper and lower rails. By virtue of the play provided in the interlocking end structures (see FIGS. 3 and 4 of that patent), the overall length of the panels assemblies can be laterally adjusted to account for variations in post-to-post distances.

Known systems employing plastic components, as described above, hold out the prospect of increased durability and reduced maintenance as compared to all-wood fencing. However, the known systems have certain drawbacks in terms of their design. For example, the cladding of the Teasdale and Miller patents does not, unless it is oversized, allow for temperature induced expansions of the wood posts and rails. As a result, bulging or detachment of the cladding may occur. Oversizing of the cladding to avoid this problem is generally undesirable from a structural standpoint, and also because it results in greater material usage and costs. In addition, since the entire circumference of the fence posts and rails are covered with the cladding, it is not possible, once the cladding is installed, to attach the rails to the posts, and the uprights to the rails, with pass-through fasteners such as nails or screws, without driving the fasteners through the cladding layer. Driving a fastener through the cladding material creates a point of fixation restricting relative movement of the cladding and underlying wood. This can result in bulging, warping, tearing and/or cracking of the cladding due to disparate temperature induced expansions/contractions of the wood and plastic material. Separate through-holes can be provided, but this requires an additional manufacturing step. In the fencing system of the Teasdale pates, complicated members are provided as integral parts of the sleeve structures, to allow for connection of wall-forming panels without the need for pass-through fasteners. While potentially avoiding the aforementioned expansion/contraction problems, such complicated structures drive costs higher, due to increased material requirements and/or additional manufacturing steps.

A fencing system rendering more cost-effective the use of plastic components to improve the durability, and decrease the maintenance, of conventional wood fencing would be highly desirable. Equally desirable would be a fencing system utilizing plastic components allowing construction of a hybrid wood/plastic fence having an attractive appearance more closely resembling an all-wood fence.

SUMMARY OF THE INVENTION

In view of the foregoing, it is a principal object of the present invention to provide a cost-effective fencing system that employs resilient plastic components to improve the durability, and decrease the maintenance, of conventional wood fencing.

It is a further object of the invention to provide a fencing system, as aforesaid, which is attractive in appearance and more closely resembles a natural wood fence.

It is still another object of the present invention to provide a hybrid fencing system which avoids damage to plastic components due to temperature induced expansions and contractions of the wood and plastic parts.

Yet another object of the invention is to provide a fencing system that is easily assembled in a manner similar to an all-wood fence, and which effectively conceals points of attachment of the component parts.

These and other objects are achieved in accordance with the present invention by a fencing system for constructing a hybrid fence. The system includes a plurality of elongated wood posts intended to be secured in upright spaced positions along a fence line. A plurality of elongated wood rails are provided for tying together the plurality of wood posts along the fence line. A plurality of uprights are provided to be secured to the rails, in side-by-side relation to each other, to form a fence wall structure.

A plurality of elongated resilient partial post-wrap components have a partial tubular profile generally matching a profile of a corresponding one of the wood posts, and spaced longitudinally extending free edges defining a first longitudinal gap therebetween. Each partial post-wrap component accommodates therein a corresponding one of the posts. A post accommodated in a corresponding partial post-wrap component is, along a substantial portion of its length, substantially covered by the partial post-wrap component, except for a strip of the post corresponding to the longitudinal gap, which remains uncovered by the partial post-wrap component.

A plurality of elongated resilient partial rail-wrap components are provided, having a partial tubular profile generally matching a profile of a corresponding one of the wood rails. The partial rail-wrap components have spaced longitudinally extending free edges defining a second longitudinal gap therebetween. Each partial rail-wrap component accommodates therein a corresponding one of the rails. A rail accommodated in a corresponding partial rail-wrap component is, along a substantial portion of its length, substantially covered by the partial rail-wrap component, except for a strip of the rail corresponding to the second longitudinal gap, which remains uncovered by the partial rail-wrap component. The first longitudinal gap in the partial post-wrap component provides an area within which a plurality of rails can be attached to the post without penetration of the partial post-wrap component by a fastener. The second longitudinal gap in the partial rail-wrap component provides an area within which a plurality of the uprights can be attached to the rails without penetration of the partial rail-wrap component by a fastener. In an assembled state of the hybrid fence, the strips of the wood posts and wood rails left exposed by the first and partial rail-wrap components are generally concealed from view by the uprights.

In a second aspect the present invention is embodied in a generally tubular tongue and groove board substitute. The board substitute has a profile defining, along a first edge, a tongue structure, and along a second opposite edge a corresponding groove structure for receiving a tongue structure of an adjacent like board substitute, to thereby form a tongue and groove interlock. The tongue structure comprises a lengthwise extending tab through which fasteners may be passed, to effect an attachment of the uprights to a supporting structure concealed within the tongue and groove interlock.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
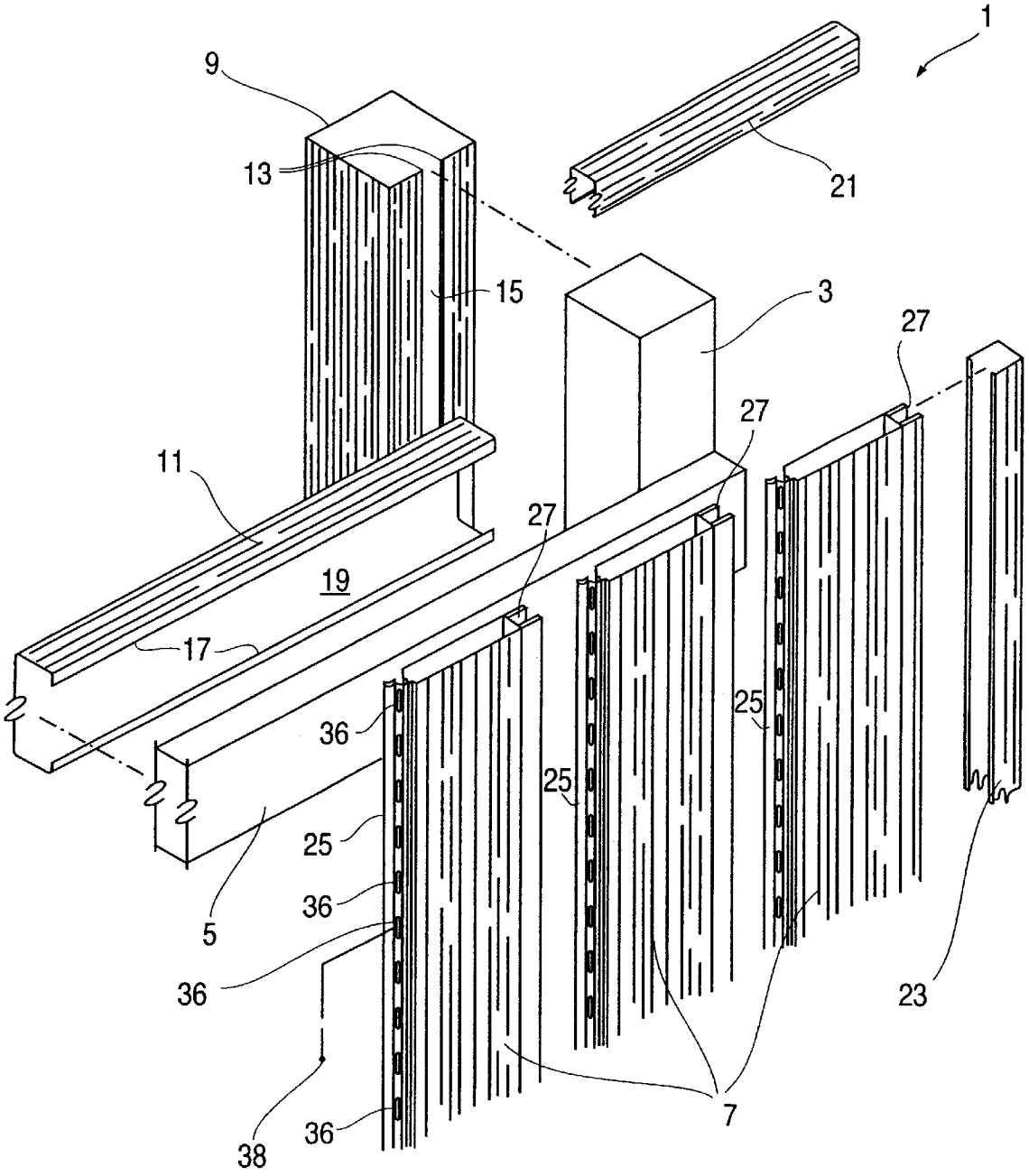
FIG. 1 is an exploded perspective view of a hybrid fencing system in accordance with the present invention.
Figure 2:
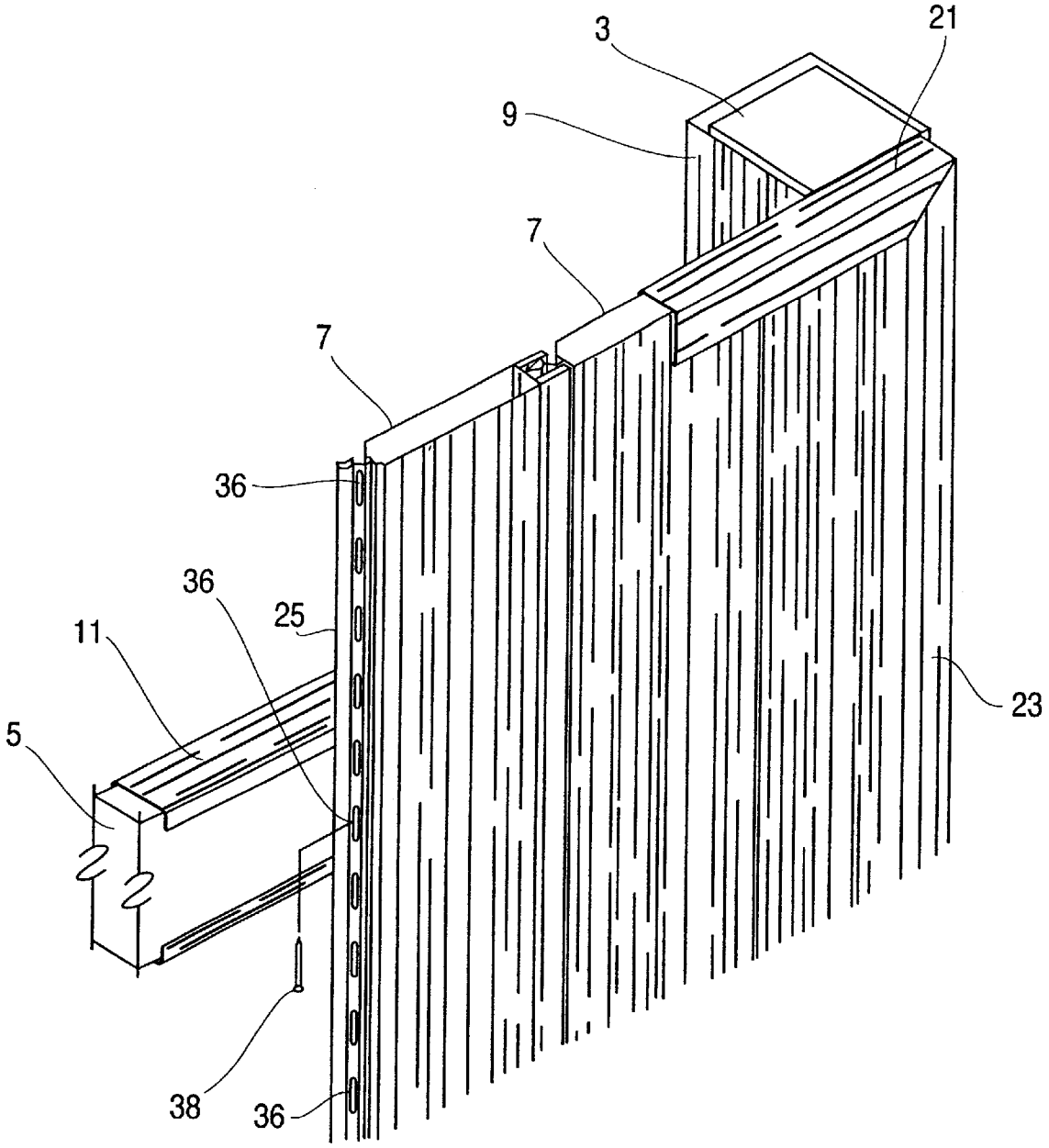
FIG. 2 is a perspective view of a fence assembly constructed from the fencing system of FIG. 1.

Referring first to FIG. 1, a fencing system 1 for constructing a hybrid fence utilizing a combination of wood and durable plastic components is shown. The system includes a plurality of elongated wood posts 3 (one shown) intended to be secured, in a conventional manner, in upright spaced positions along a fence line. A plurality of elongated wood rails 5 (one shown) are provided for tying together the wood posts along the fence line. A plurality of uprights 7 are included, which are intended to be secured to the rails in a side-by-side relation to each other, to form a fence wall structure. Fencing system 1 is used to construct a fence of known stockade style, an assembly of which is shown in FIG. 2.

Figure 5:
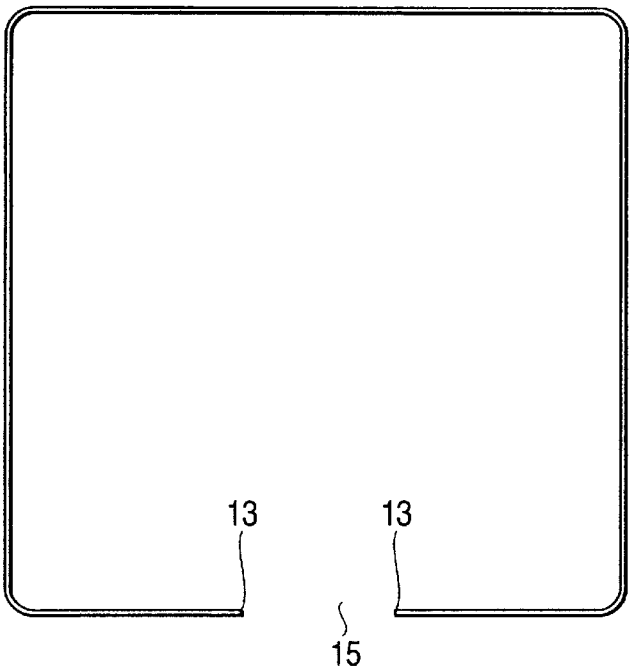
FIG. 5 is an end view of a partial post wrap component of the hybrid fencing system of FIG. 1.

Fencing system 1 further includes a plurality of elongated resilient partial post-wrap components 9 (one shown), and a plurality of elongated resilient partial rail-wrap components 11 (one shown). Post-wrap components 9 have a partial tubular profile (end view shown in FIG. 5) generally matching a profile of a corresponding one of wood posts 3, and have spaced longitudinally extending free edges 13 defining a first longitudinal gap 15 therebetween. Each partial post-wrap component accommodates therein a corresponding one of posts 3 such that the post is, along a substantial portion of its length, substantially covered by wrap component 9, except for a strip of post 3 corresponding to longitudinal gap 15, which remains uncovered by post-wrap component 9.

Figure 4:
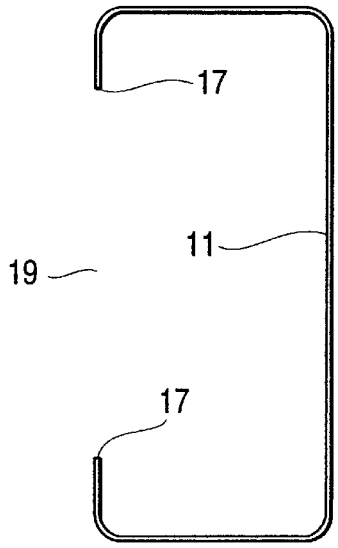
FIG. 4 is an end view of a partial rail wrap component of the hybrid fencing system of FIG. 1.

The partial rail-wrap components 11 similarly have a partial tubular profile (end view shown in FIG. 4) generally matching a profile of a corresponding one of wood rails 5, and have spaced longitudinally extending free edges 17 defining a second longitudinal gap 19 therebetween. Each partial rail-wrap component accommodates therein a corresponding one of rails 5 such that the rail is, along a substantial portion of its length, substantially covered by partial rail-wrap component 11, except for a strip of rail 5 corresponding to second longitudinal gap 19, which remains uncovered by rail-wrap component 11.

Partial post-wrap components 9 and partial rail-wrap components 11 are preferably formed of a durable and weather resistant plastic material such as polyvinyl chloride (PVC). For improved fade resistance with darker fence colors, acrylonitrile styrene acrylic (ASA) is preferred, e.g., GELOY produced by General Electric Company. The components are preferably resilient enough to allow free edges 13, 17 to be resiliently spread apart, increasing the size of gaps 15 and 19 sufficiently to allow insertion of the corresponding post and rail, respectively. Alternatively the posts and rails may be inserted end-wise into the wrap components. At the same time, the material should be sufficiently hard and rigid to provide substantial durability, and to inhibit easy removal of the wrap components from rails 5 and posts 3 once they have been installed.

Figure 3:
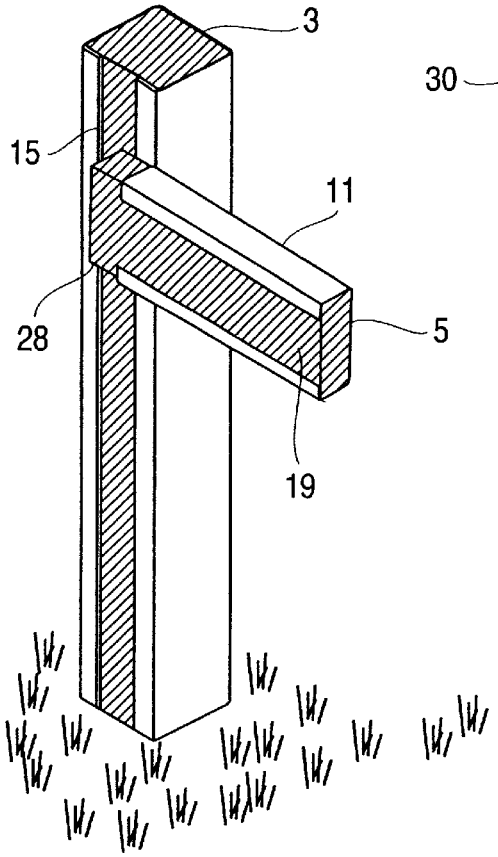
FIG. 3 is a perspective view of a rail/post sub-assembly of the fencing system of FIG. 1.

Longitudinal gap 15 in partial post-wrap 9 provides an area within which a plurality of rails 5 can be attached to post 3, as shown in FIG. 3, without penetration of wrap component 9 by a pass-through fastener, e.g., nail or screw. Similarly, gap 19 in partial rail-wrap component 11 provides an area within which a plurality of uprights 7 can be attached to rails 5 without penetration of the partial rail-wrap component by a fastener. This avoids creation of a point of fixation restricting relative movement of the wrap-components and the underlying wood components, such that these materials can expand and contract with changes in temperature without causing bulging, warping, tearing and/or cracking of the wrap-components. In addition, because the surface area covered with plastic is decreased relative to the cladding of the prior art (which wraps about an entire circumference of the underlying wood component), significant savings in plastic material can be realized. At the same time, in an assembled state of the hybrid fence, the strips of wood left exposed on the wood rails and posts by the corresponding partial-wrap components are generally concealed from view by uprights 7. This can be seen in the assembly of FIG. 2.

Figure 6:
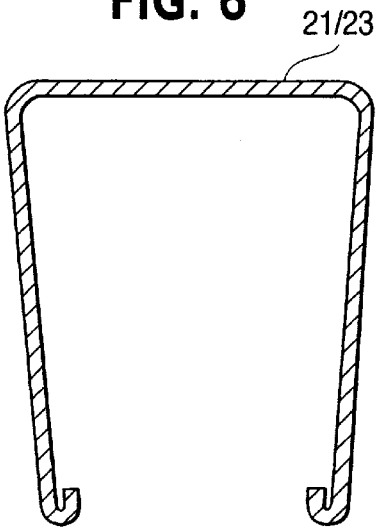
FIG. 6 is a transverse cross-sectional view of a top (or end) cap member of the hybrid fencing system shown in FIG. 1.
Figure 7:
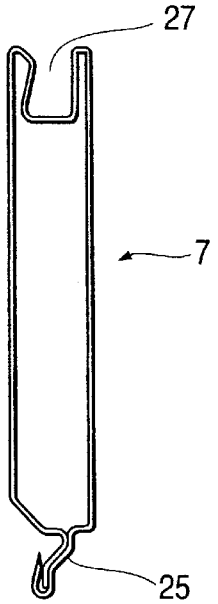
FIG. 7 is an end view of a generally tubular board substitute of the hybrid fencing system of FIG. 1.

To finish-off the fence, fencing system 1 further includes a generally U-shaped top cap member 21 and an identically shaped generally U-shaped end cap member 23 (end view shown in FIG. 6) which may be cut from the same piece of stock material. Top cap member 21 fits over exposed upper ends of a series of uprights 7 secured to rails 5. End cap member 23 fits over an exposed edge of an end one of a series of uprights 7 secured to the rails.

In the preferred embodiment, uprights 7 comprise generally tubular board substitutes formed of the same plastic material used to make the partial-wrap components and cap members, and the board substitutes have a profile defining along a first edge a tongue structure 25, and along a second opposite edge a corresponding groove structure 27 for receiving a tongue structure of an adjacent like board substitute, to form a series of tongue and groove interlocks. At one end, end cap member 23 will fit over an exposed (vacant) groove structure. At the other end of the fence, the cap member fits over an exposed tongue structure.

The plastic components of the inventive fence system may be formed by known techniques such as extrusion. Preferably, however, the components are formed by post-forming an extruded sheet of PVC or other plastic material, in a manner generally similar to that described in commonly assigned co-pending application Ser. No. 08/593,411, filed Jan. 29, 1996 (hereby incorporated by reference in its entirety). While various thicknesses of the material can be utilized, a nominal thickness of 0.030"–0.050" has been found to work satisfactorily for partial wrap components used in connection with posts measuring approximately 4" on each side, and rails measuring approximately 3.6×1.6". Uprights 7 preferably have a nominal wall thickness in the range of 0.050"–0.070". Preferably, all of the plastic components are embossed to have a texture and appearance resembling the grain of natural wood. Color variegations may be provided as well.

Figure 3A:
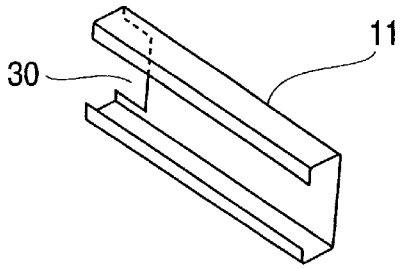
FIG. 3A is a perspective view of a partial rail wrap component, usable in the rail/post sub-assembly of FIG. 3.

Once the wrap components are installed, the rails may be secured to the posts in a manner substantially the same as that used in conventional wood stockade fence construction. The wrap components preferably fit snugly onto the boards and rails, such that additional means for fastening the wrap components on the boards and rails is unnecessary. If desired, small tack-nails or the like could be used to provide additional securement, but this has the drawback previously mentioned related to temperature induced expansions of the wood and plastic material. To make the best use of the gaps provided by the wrap components, rails 5 are preferably secured to the posts by driving a nail or screw through an end portion 28 of rail 5 left exposed by cutting rail-wrap component 11 somewhat shorter than rail 5. The fastener passes through rail 5 and into post 3, within the exposed post area defined by gap 15, such that the wrap components are not penetrated and thereby fixated. Alternatively, instead of undersizing the length of rail-wrap component 11, the backside thereof can be provided with a notch 30, as seen in FIG. 3A, leaving exposed a backside rail surface area that can be placed in registry with the exposed post area, for effecting an attachment without penetrating (and fixating) the wrap components.

Uprights (interchangeably referred to as board substitutes) 7 are now described in greater detail. As previously mentioned, board substitutes 7 have a profile defining along a first edge a tongue structure 25 and along a second opposite edge a corresponding groove structure 27, for receiving a tongue structure 25 of an adjacent like board substitute to, to thereby form a series of tongue and groove interlocks. As best seen in FIG. 9, tongue structure 25 comprises a lengthwise extending tab 29 through which fasteners, e.g. screws or nails, may be passed, to effect an attachment of uprights 7 to rails 5 that will become concealed within the tongue and groove interlock. Tab 29 is formed by overlapped end portions 31, 33 of the plastic material forming the tubular shape of uprights 7. Overlapped end portion 33 has a loop portion 35 that wraps around other end portion 31. Loop portion 35 serves to stiffen and strengthen tab 29, and to interlock with an interior surface 34 of a corresponding groove structure 27 (see FIG. 8) of an adjacent like board substitute 7. As seen clearly in FIGS. 1 and 2, tongue 25 (incorporating tab 29) extends continuously along the entire extent of a first edge of upright 7. Obviously, if desired, portions of the tongue/tab could be omitted where attachment to a supporting structure is not required, so long as sufficient interlocking strength is provided by the tongue/tab portions that remain. Tab 29 forms a series of elongated passages 36 through which fasteners 38, e.g., nails or screws, may freely pass.

Figure 9:
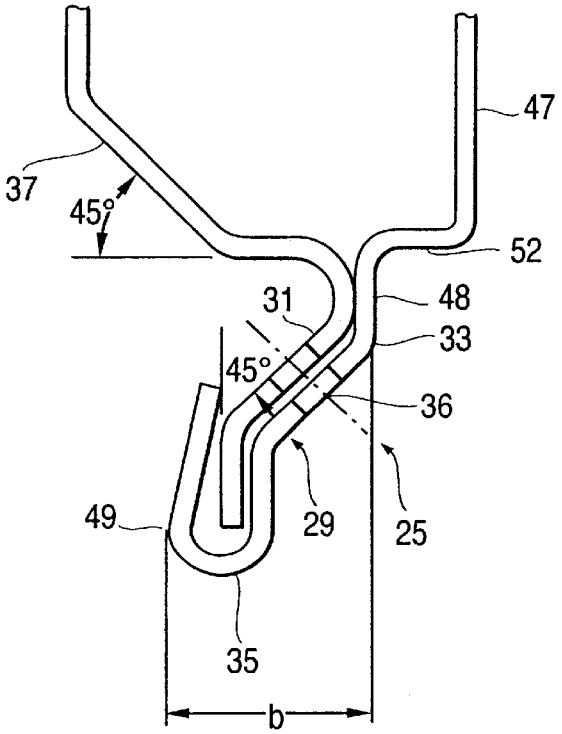
FIG. 9 is a close-up cross-sectional view of a tongue structure of the tubular board substitute of FIG. 7.
Figure 10:
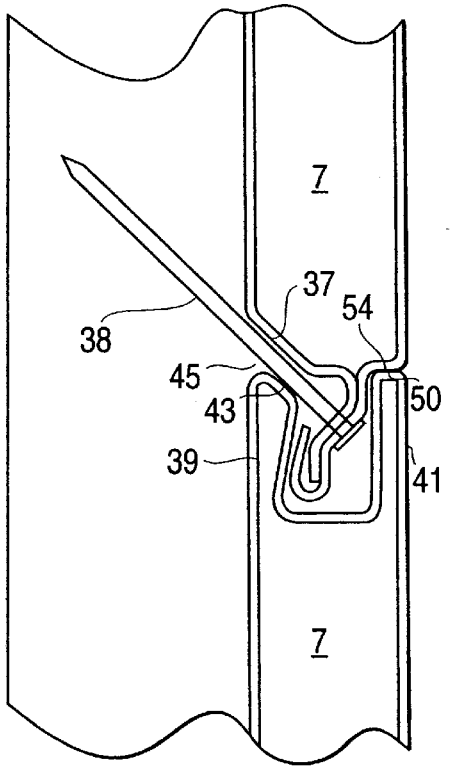
FIG. 10 is a close-up cross-sectional view of a tongue and groove interlock of two adjacent tubular board substitutes.

In addition to the tongue structure, the first edges of uprights 7 comprise an obliquely angled surface 37 adjacent tab 29 (see FIG. 9). The axes of passages 36 are aligned to extend generally parallel to angled surface 37 such that a fastener 38 passing therethrough, to provide an attachment to a rail 5, extends generally along angled surface 37, as best seen in FIG. 10. It has been found that an angle of 45° (measured with respect to the parallel faces of the board substitutes 7) works well for surface 37, and for the central portion of tab 29 through which passages 36 are provided. Other angles could be utilized as well.

Figure 8:
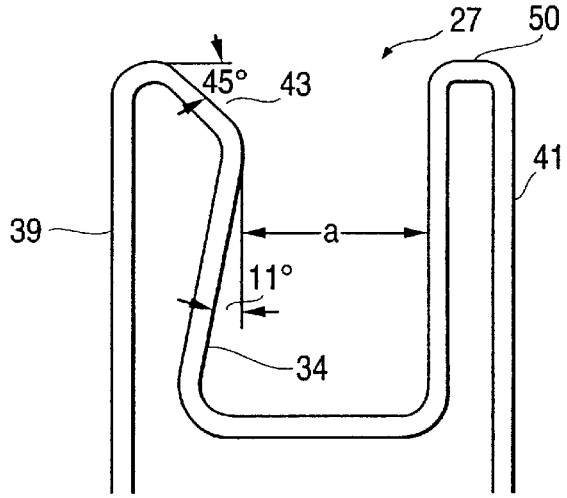
FIG. 8 is a close-up cross-sectional view illustrating a groove structure of the tubular board substitute of FIG. 7.

Referring now to FIG. 8, groove structure 27 is described in greater detail. Groove structure 27 comprises a pair of flange-like extensions 39, 41 of the plastic material forming the generally tubular shape of the board substitutes. An end of flange 39 has an obliquely angled surface 43 corresponding to obliquely angled surface 37. Groove 27 thereby accommodates therein a tongue structure 25/tab 29 of an adjacent like board substitute 7 in such a manner that a lengthwise extending slot 45 (see FIG. 10) is formed between the obliquely angled surfaces 37, 43, in alignment with tab passages 36, whereby fasteners extending through passages 36 and fastened to a rail 5 extend through slot 45.

As best seen in FIG. 8, interior surface 34 of flange 39 is angled by 11° relative to the outer faces of the board substitute, such that the width of the groove flares outwardly from a minimum dimension (a) at a point adjacent angled end surface 43 to a maximum dimension at the bottom of the groove. The minimum dimension (a) is slightly less than the distance (b) (see FIG. 9) between a tongue structure shoulder surface 48 and the outermost part 49 of loop 35. Tongue structure 25 is insertable into groove 27 with a snap-action obtained by slightly undersizing minimum dimension (a) relative to distance (b). Flange 41 has an end surface 50 which abuts with a second end surface 52 adjacent a tongue structure 25 of an adjacent like board substitute 7, to thereby conceal tab 25 (and fasteners 38) from view, as best seen in FIG. 10. Generally, the interlock operation is performed following securement of one upright to rails 5 or other supporting structure, and as a next upright is placed into position.

The present invention has been described in terms of preferred and exemplary embodiments thereof Numerous other embodiments, modifications and variations within the scope and spirit of the appended claims will occur to persons of ordinary skill in the art from a review of this disclosure.

What is claimed is:

1. A fencing system for constructing a hybrid fence, comprising:

a plurality of elongated wood posts intended to be secured in upright spaced positions along a fence line;

a plurality of elongated wood rails for tying together the plurality of wood posts along said fence line;

a plurality of uprights intended to be secured to said rails, in side-by-side relation to each other, to form a fence wall structure;

a plurality of elongated resilient partial post-wrap components having a partial tubular profile generally matching a profile of a corresponding one of said wood posts, and having spaced longitudinally extending free edges defining a first longitudinal gap therebetween, each partial post-wrap component accommodating therein a corresponding one of said posts, wherein each of said posts accommodated in a corresponding one of said partial post-wrap components is, along a substantial portion of its length, substantially covered by said partial post wrap component, except for a strip of said post corresponding to said longitudinal gap, which remains uncovered by said partial post-wrap component; and a plurality of elongated resilient rail-wrap components having a partial tubular profile generally matching a profile of a corresponding one of said wood rails, and having spaced longitudinally extending free edges defining a second longitudinal gap therebetween, each partial rail-wrap component accommodating therein a corresponding one of said rails, wherein each of said rails accommodated in a corresponding one of said partial rail-wrap components is, along a substantial portion of its length, substantially covered by said partial rail-wrap component, except for a strip of said rail corresponding to said second longitudinal gap, which remains uncovered by said partial rail-wrap component, and an end portion of said rail that remains uncovered by said partial rail-wrap component for permitting attachment of said rails to said posts within the longitudinal gap of said partial post-wrap components;

wherein:

said first longitudinal gap in said partial post-wrap components provides an area for attaching said plurality of rails to said posts without penetration of said partial post-wrap components by a fastener; and said second longitudinal gap in said partial rail-wrap component provides an area for attaching said plurality of said uprights to said rails without penetration of said partial rail-wrap component by a fastener; whereby, in an assembled state of the hybrid fence, the strips of said wood posts and said wood rails left exposed by said partial post-wrap and partial rail-wrap components may be generally concealed from view by said uprights.

2. A fencing system according to claim 1, wherein said partial post and rail-wrap components are formed of plastic material.

3. A fencing system according to claim 2, wherein said plastic material comprises polyvinyl chloride.

4. A fencing system according to claim 1, wherein said posts have a generally square profile and said partial post-wrap components have a corresponding, but incomplete, generally square shape sized to fit over said posts.

5. A fencing system according to claim 1, wherein said rails have a generally rectangular profile and said partial rail-wrap components have a corresponding, but incomplete, generally rectangular shape sized to fit over said rails.

6. A fencing system according to claim 1, wherein said uprights comprise generally tubular board substitutes formed of plastic material.

7. A fencing system according to claim 6, wherein said plastic material comprises polyvinyl chloride.

8. A fencing system according to claim 6, further comprising a generally U-shaped top cap member for fitting over exposed upper ends of a series of said uprights when said uprights are secured to said rails and interlocked with each other by a tongue and groove interlock.

9. A fencing system according to claim 6, further comprising a generally U-shaped end cap member for fitting over an exposed edge of an end one of a series of said uprights when said uprights are secured to said rails and interlocked with each other by a tongue and groove interlock.

10. A fencing system according to claim 6, wherein said board substitutes have a profile defining along a first edge a tongue structure and along a second opposite edge a corresponding groove structure for receiving a tongue structure of an adjacent like board substitute, to form a tongue and groove interlock.

11. A fencing system according to claim 10, wherein said tongue structure comprises a lengthwise extending tab for passing fasteners therethrough, to effect an attachment of said uprights to said rails concealed within said tongue and groove interlock.

12. A fencing system according to claim 11, wherein said tab is formed by overlapped end portions of plastic sheet material forming a tubular shape of the board substitutes.

13. A fencing system according to claim 12, wherein one of said overlapped end portions has a loop portion that wraps around the other overlapped end portion, said loop portion serving to stiffen and strengthen said tab, and to interlock with the corresponding groove structure of an adjacent like board substitute.

14. A fencing system according to claim 11, wherein said tab extends continuously along said first edge.

15. A fencing system according to claim 11, wherein said tab forms a passage through which a fastener may freely pass.

16. A fencing system according to claim 15, wherein said first edge comprises an obliquely angled surface adjacent said tab, and an axis of said passage is aligned to extend generally parallel to said angled surface such that a fastener passing therethrough to provide an attachment to a rail extends generally along said angled surface.

17. A fencing system according to claim 16, wherein said angled surface is angled approximately 45° with respect to parallel faces of said board substitute.

18. A fencing system according to claim 16, wherein the groove at said second edge of the board substitute is formed between a pair of flange extensions of said generally tubular shape, an end of a first one of said flanges having an obliquely angled surface corresponding to the obliquely angled surface of said first edge, whereby said groove accommodates therein a said tab of an adjacent said board substitute in such a manner that a slot is formed between the obliquely angled surfaces of said flange and said first edge, in alignment with said passage, whereby a fastener extending through said passage and fastened to said rail extends through said slot.

19. A fencing system according to claim 18, wherein a second one of said flanges has an end surface which abuts with a second end surface of an adjacent said board substitute to conceal said tab from view.

20. A fencing system according to claim 1, wherein said uprights comprise a generally tubular tongue and groove board substitutes, each said board substitute having a profile defining along a first edge a tongue structure and along a second opposite edge a corresponding groove structure for receiving a tongue structure of an adjacent said board substitute to thereby form a tongue and groove interlock, said tongue structure comprising a lengthwise extending tab for passing fasteners therethrough to effect an attachment of said board substitute to a supporting structure concealed within the tongue and groove interlock; wherein:

said tab forms a passage for freely passing a fastener therethrough; and said first edge comprises a first surface and a second surface separated by said tab, and said second edge comprises a first flange and a second flange that form said groove structure; whereby, upon joinder of a pair of adjacent first and second said board substitutes to form said tongue and groove interlock, a slot is formed between said first surface of the first board substitute and said first flange of said second board substitute, a fastener fastening the board substitutes to said supporting structure may extend through said slot, and said second surface of said first board substitute abuts said second flange of said second board substitute, thereby concealing said tab from view.

21. A generally tubular tongue and groove board substitute, said board substitute having a profile defining along a first edge a tongue structure and along a second opposite edge a corresponding groove structure for receiving a tongue structure of an adjacent said board substitute to thereby form a tongue and groove interlock, said tongue structure comprising a lengthwise extending tab for passing fasteners therethrough, to effect an attachment of said board substitutes to a supporting structure concealed within the tongue and groove interlock; wherein:

said tab forms a passage for freely passing a fastener therethrough; and said first edge comprises an obliquely angled surface adjacent said tab, and an axis of said passage is aligned and extending generally parallel to said angled surface such that a fastener passing therethrough to provide an attachment to said supporting structure extends generally along said surface.

22. A tongue and groove board substitute according to claim 21, wherein said tab is formed by overlapped end portions of sheet material forming a tubular shape of the board substitute.

23. A tongue and groove board substitute according to claim 22, wherein one of said overlapped end portions has a loop portion that wraps around the other end portion, said loop portion serving to stiffen and strengthen said tab, and to interlock with a corresponding groove structure of an adjacent like board substitute.

24. A tongue and groove board substitute according to claim 21, wherein said tab extends continuously along said first edge.

25. A tongue and groove board substitute according to claim 21, wherein said angled surface is angled approximately 45° with respect to parallel faces of said board substitute.

26. A tongue and groove board substitute according to claim 21, wherein the groove at said second edge of the board substitute is formed between a pair of flange extensions of said generally tubular shape, an end of a first one of said flanges having an obliquely angled surface corresponding to the obliquely angled surface of said first edge, whereby said groove accommodates therein a said tab of an adjacent said board substitute in such a manner that a slot is formed between the obliquely angled surface of said first flange, and the obliquely angled surface of said first edge, in alignment with said passage, whereby a fastener extending through said passage and fastened to said supporting structure extends through said slot.

27. A tongue and groove board substitute according to claim 26, wherein a second one of said flanges has an end surface serving to abut with a second end surface of an adjacent said board substitute to thereby conceal said tab from view.

28. A generally tubular tongue and groove board substitute in combination with a fastener, said board substitute having a profile defining along a first edge a tongue structure and along a second opposite edge a corresponding groove structure for receiving a tongue structure of an adjacent like board substitute to thereby form a tongue and groove interlock, said tongue structure comprising a lengthwise extending tab, through which said fastener is passed to effect an attachment of said board substitute to a supporting structure concealed within the tongue and groove interlock; wherein:

said first edge comprises a first surface and a second surface separated by said tab, and said second edge comprises a first flange and a second flange that form said groove structure; whereby, upon joinder of a pair of adjacent first and second said board substitutes to form said tongue and groove interlock, a slot is formed between said first surface of the first board substitute and said first flange of said second board substitute, said fastener extends through said tab and said slot, and said second surface of said first board substitute abuts a said second flange of said second board substitute, thereby concealing said tab from view.

* * * * *

UNITED STATES PATENT AND TRADEMARK OFFICE

CERTIFICATE OF CORRECTION

PATENT NO. : 6,311,955 B1
DATED : November 6, 2001
INVENTOR(S) : Benjamin L. McGarry et al.

It is certified that error appears in the above-identified patent and that said Letters Patent is hereby corrected as shown below:

Column 8,
Line 63, “a generally” has been replaced with -- generally --.

Column 9,
Lines 6 and 7, “said tab forms a passage for freely passing a fastener therethrough; and” has been deleted.
Line 33, “forms” has been replaced with -- includes --,
Line 38, “therethrough” has been replaced with -- therethrough, --,
Line 39, “structure” has been replaced with -- structure, --.

Signed and Sealed this

Fifteenth Day of October, 2002

*Attest:*

*Attesting Officer*

JAMES E. ROGAN
*Director of the United States Patent and Trademark Office*